US005215381A

United States Patent [19]

Wade

[11] Patent Number: 5,215,381

[45] Date of Patent: Jun. 1, 1993

[54] OPENING DEVICE FOR FLEXIBLE PACKAGING

[76] Inventor: Steven E. Wade, 100 Main St., Winona, W. Va. 25942

[21] Appl. No.: 863,016

[22] Filed: Apr. 3, 1992

Related U.S. Application Data

[63] Continuation-in-part of Ser. No. 510,203, Apr. 17, 1990, Pat. No. 5,127,065.

[51] Int. Cl.[5] ..... B65D 3/26

[52] U.S. Cl. ..... 383/205; 383/200

[58] Field of Search ..... 229/309, 310, 924, 926; 383/200, 205

[56] References Cited

U.S. PATENT DOCUMENTS

| | | | |
|---|---|---|---|
| 1,587,280 | 6/1926 | Burke | 229/924 |
| 1,983,400 | 12/1934 | Reiner | 229/310 |
| 2,119,793 | 6/1938 | Plageman | 229/51 |
| 2,152,400 | 3/1939 | Da Rold | 229/51 |
| 2,263,353 | 11/1941 | Eidam | 30/2 |
| 3,170,619 | 2/1965 | Repko | 383/205 |
| 3,446,632 | 5/1969 | Ve Van | 383/205 |
| 3,561,665 | 2/1971 | Smith | 229/924 |
| 3,730,421 | 5/1973 | Stanley | 383/205 |
| 3,759,439 | 9/1973 | Cross et al. | 383/205 |
| 3,799,389 | 3/1974 | Bloeck | 220/49 |
| 4,027,819 | 6/1977 | Herrera-Gutierrez | 229/65 |
| 4,363,406 | 12/1982 | Salvadori | 383/200 |
| 4,480,751 | 11/1984 | Lueptow | 383/200 |
| 4,597,450 | 7/1986 | Budmiger | 169/50 |
| 4,619,650 | 10/1986 | Wisdom | 604/408 |
| 4,664,263 | 6/1987 | Emslander et al. | 206/630 |
| 4,696,404 | 9/1987 | Corella | 383/200 |
| 4,708,249 | 11/1987 | Emslander et al. | 206/630 |
| 4,925,034 | 5/1990 | Robichaud et al. | 206/603 |
| 5,035,328 | 7/1991 | Kim | 383/205 |
| 5,127,065 | 6/1992 | Wade | 383/200 |

FOREIGN PATENT DOCUMENTS

| | | | |
|---|---|---|---|
| 1065305 | 1/1954 | France . | |
| 2-242746 | 9/1990 | Japan | 383/200 |

OTHER PUBLICATIONS

G. Erickson, "Packaging for Older Consumers", *Packaging,* Nov. 1990.

*Primary Examiner*—David T. Fidei

*Attorney, Agent, or Firm*—Kerkam, Stowell, Kondracki & Clarke

[57] ABSTRACT

An opening device for flexible packaging is provided to concentrate tearing forces and provide increased tearing leverage, facilitating the opening of the packaging without the need for a sharp object to initiate the tear, the opening device having first and second wings spaced apart from one another at a narrow distance and joined at a proximal end by an integral web, which acts as a fulcrum for each of the wings as they are rotated to initiate the tear. The opening device is securely fastened to a peripheral edge of the package and a predetermined portion of the first and second wings extend outwardly away from the peripheral edge, the wings serving as gripping surfaces which are rotated apart from one another in initiating the tear in the package. An alternative embodiment employs first and second wings or levers secured to opposite sides of a sealed edge of the package, which levers operate about a common fulcrum at the innermost portions of the proximal ends of the levers to magnify and concentrate tearing forces.

9 Claims, 6 Drawing Sheets

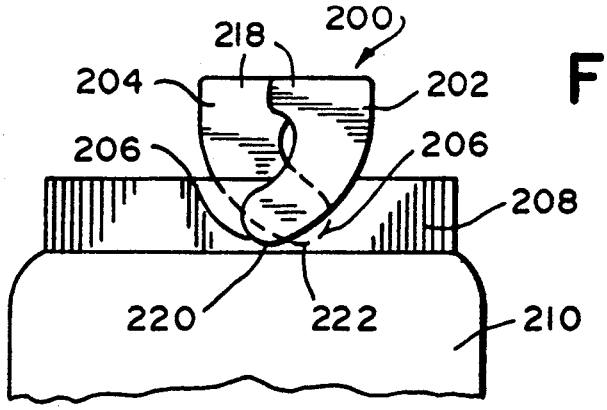
FIG. 9
FIG. 10
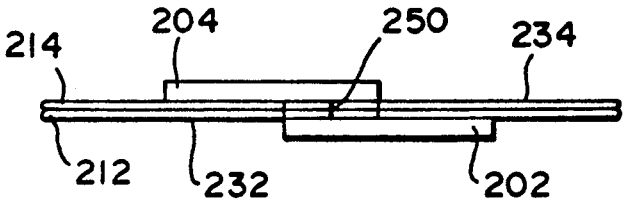
FIG. 11
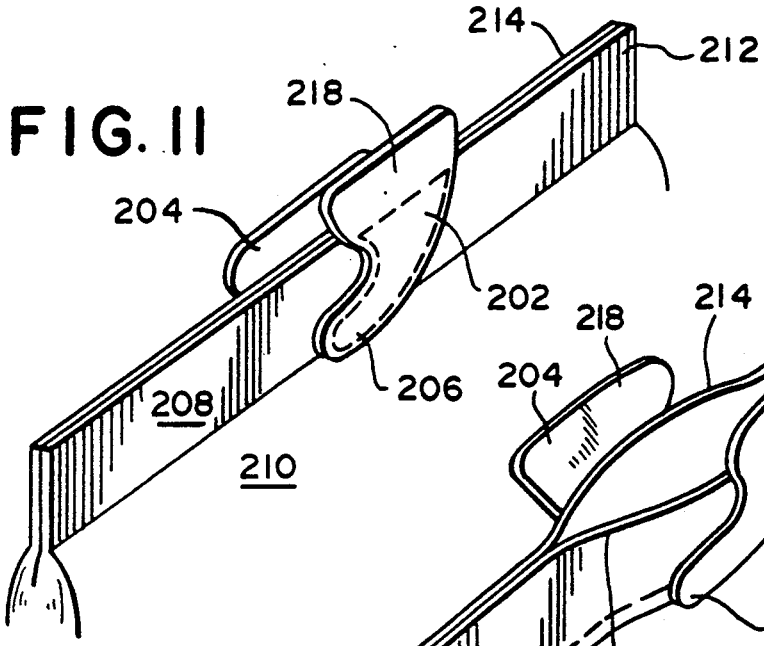
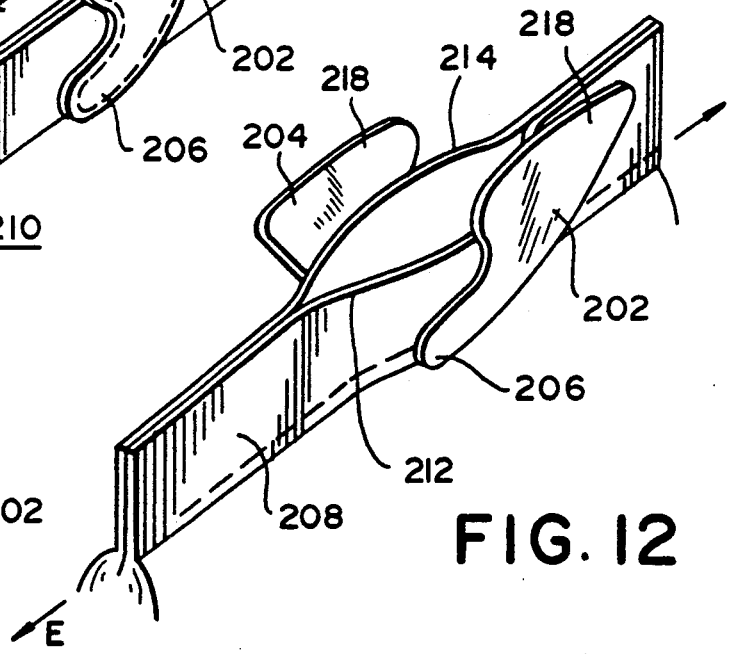
FIG. 12
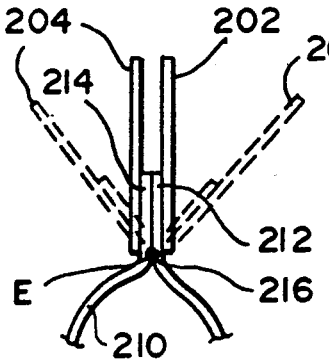
FIG. 13

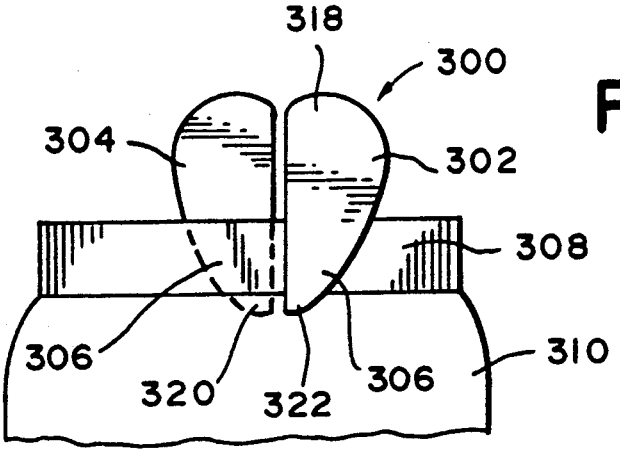
FIG. 14
FIG. 15
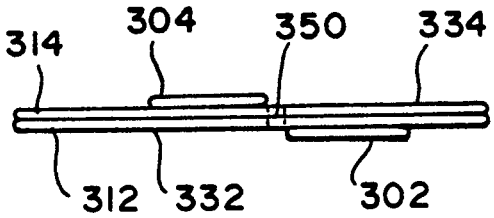
FIG. 16
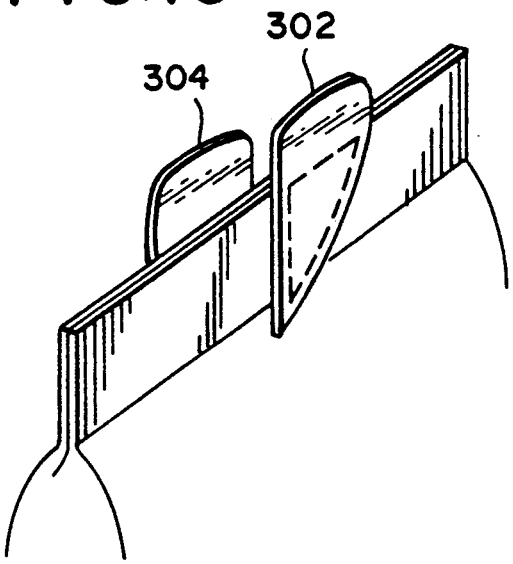
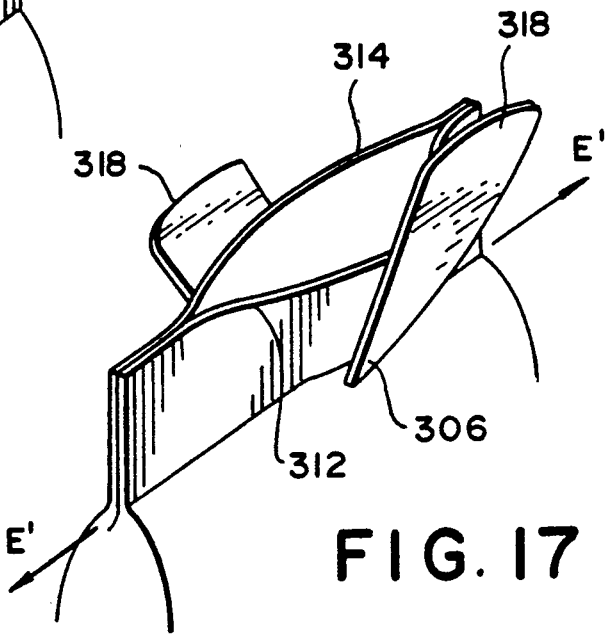
FIG. 17
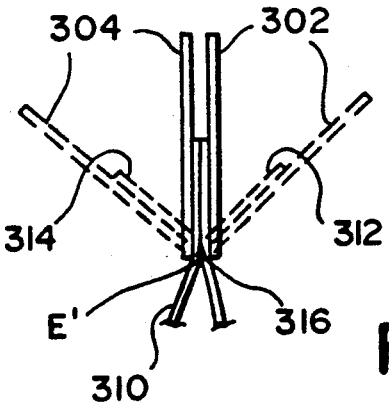
FIG. 18

OPENING DEVICE FOR FLEXIBLE PACKAGING

CROSS-REFERENCE TO RELATED APPLICATION

The present application is a continuation-in-part of application Ser. No. 07/510,203, filed Apr. 17, 1990, now U.S. Pat. No. 5,127,065.

BACKGROUND OF THE INVENTION

Field of the Invention

The present invention relates to a device which is fastened to flexible packaging to assist in tearing open the packaging without the use of an additional tool.

Description of Related Art

A major consideration in designing packaging for various consumer products is the manner in which the packaging may be opened by the end user of the product. As an example, steel and aluminum cans have long been used to contain individual servings of carbonated and non-carbonated beverages. Initially, such cans required the use of an additional tool, the can opener, to pierce an opening or openings in the lid portion of the can in order to extract the beverage. A significant disadvantage associated with this type of packaging was that can openers were not always readily available when a person wished to open the can.

Recognizing this disadvantage, package designers developed the "flip-top" can, which now enjoys widespread use in individual serving sized cans. The flip-top employs the physical principles of leverage and isolation of stressed material to eliminate the need for an additional tool, such as the can opener, because a leveraging means and a weakened region of the lid are provided on each can. Consumer reaction to this and other improvements, however slight, in package opening convenience has been so overwhelmingly positive that it is presently difficult to find cans or boxes requiring additional tools to open them.

In the field of flexible packaging, e.g., polymeric bags, however, one often finds that opening the package requires a separate or additional tool such as a pair of scissors, a knife, or one of numerous tools old for the express purpose of performing the package opening function. While most flexible packaging for consumer goods is ostensibly designed to be opened with normal manual effort, in reality many of these packages require near-superhuman effort to effect the opening of the package, and many consumers thus resort to the use of an opening tool.

Numerous approaches have been taken to alleviate the problem of opening bag-type flexible packaging without the need for an additional tool. Slits or v-notches have been provided on the edges of packages in order to provide a tear initiation site, which overcomes one problem associated with the opening of flexible packaging. Some packaging designs have employed a weakened line of material extending through the package which is somewhat similar in concept to scoring the lid of a flip-top can in that the weakened line provides a "path of least resistance" for tear propagation, and tends to concentrate tearing stresses in that region. It should be readily apparent that employing weakened lines in the packaging material has the disadvantage that the package might be inadvertently opened in the transportation or handling of the packages prior to reaching the end user.

Tear strips or tear strings have also been employed in flexible packaging in order to avoid the necessity of using an opening tool. The use of tear strips or tear strings often complicates the packaging operation itself, thereby driving up the product manufacturing cost, which is ultimately passed on to the consumer. Finger or hand grasping means have previously been employed in attempts to facilitate the opening of flexible packaging. The grasping means previously employed have generally been integral extensions of the packaging material itself, or exposed extensions of tear strips or tear strings. Such grasping means, while improving the ability to apply tearing forces to the package, have not provided any substantial force magnification or stress concentration which would ease the opening of the package.

It is therefore an important object of the present invention to provide an opening device which is fixedly attached to a flexible packaging container, and which provides multiplication of tearing forces and concentration of tearing stress in an isolated region of the packaging to facilitate the opening of the packaging by exertion of manual force.

It is a further important object of the present invention to provide an opening device which is to be fixedly attached to a flexible packaging container and which comprises a pair of closely spaced wing-like members or levers, the distal ends of which extend from a peripheral edge of the packaging, the wing-like members having a common fulcrum at their proximal ends wherein a proximal end portion of each wing is secured to the packaging.

It is another important object of the present invention to provide a flexible package opening device made of a relatively inexpensive material and which is further easily secured to the flexible package as the package is formed and sealed, the opening device providing means for concentrating and isolating tearing stresses at a predetermined narrow region of the package and a means for increasing a tearing force exerted by a person opening the package.

SUMMARY OF THE INVENTION

The above and other objects of the present invention are accomplished by providing an opening device comprising a substantially rigid pair of wing-like members joined at a proximal end by an integral web, the pair of plastic wings being closely spaced from one another and defining a narrow slit therebetween. The web and a portion of the length of each wing-like member are secured or fixedly attached to a package made of flexible material, and the distal ends of the wings extend outwardly from a peripheral edge of the package. The opening device is fixedly attached to the package during the packaging and sealing process by heat sealing the device to the package material in the desired location or by other suitable attachment means.

The device alternatively comprises a substantially rigid pair of levers or wing-like members, the proximal ends of which are attached to opposite sides of a package seal such that the proximal ends are in sufficiently close relationship to form The device assists in opening the package by providing increased leverage in applying tearing forces, as well as providing an isolation of a narrow region of flexible material in the space between the two wings, which focuses or concentrates the tearing forces and stresses in that region of the package. A person desiring to open the package may grip each of the substantially rigid wing-like members near the distal ends thereof between a thumb and forefinger, and may simply move or rotate the members relative to one another out of the plane in which the wing-like members are originally disposed. Because the members are substantially rigid and are hinged together by the web at a proximal end of the device, the web acts as a fulcrum point, and additional leverage is provided, as the force applied by the person opening the package is applied at a greater distance than if he or she were grasping the bag directly at the peripheral edge. Further, the tearing forces are focused or concentrated only in the narrow slit region between the wing-like members because the package and the device are secured together along a portion of the length of the wing-like members. The increased leverage and the concentration of tearing stresses will initiate and begin the propagation of a tear in the peripheral edge of a wide variety of flexible packaging materials. As the distal ends of the wing-like members are moved or rotated farther apart relative to one another, the tear propagates inwardly from the peripheral edge of the package toward the proximal ends of the wing-like members and the web connecting the members. The opening device is designed and is secured to the package in such a manner that the web will fracture just prior to or substantially concurrently with the leading edge of the propagating tear reaching that point, due to the increased stress in that area resulting from the increased separation between the distal ends of the opening device.

As indicated previously, the opening device may be heat sealed or otherwise securely adhered to one of the outer surfaces of the package at a selected peripheral edge of the package. Alternatively, the device may be sealed or securely adhered between two mating inner surfaces of the peripheral portions of the package which are themselves sealed together in sealing the package. The device thus provides an inexpensive and reliable means for opening flexible packaging which eliminates the need for an additional tool in opening the package.

The device alternatively comprises a substantially rigid pair of levers or wing-like members, the proximal ends of which are attached to opposite sides of a package seal such that the proximal ends are in sufficiently close relationship to form a common fulcrum at the innermost portions of the proximal ends.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention, taken in conjunction with the accompanying drawings wherein like reference characters represent like parts throughout the several views.

FIG. 9 is an elevation view of a further alternative preferred embodiment of the opening device and package of the present invention.

FIG. 10 is a top plan view of the device and package of the FIG. 9 embodiment.

FIG. 11 is a perspective view of the FIG. 9 embodiment prior to the device being used to open the package.

FIG. 12 is a perspective view of the FIG. 9 embodiment after the device has been used to initiate the opening of the package.

FIG. 13 is a side view of the opening device of FIG. 9 nd the portion of the package to which the device is secured.

FIG. 14 is an elevation view of a further alternative preferred embodiment of the opening device and package of the present invention.

FIG. 15 is a top plan view of the device and package of the FIG. 13 embodiment.

FIG. 16 is a perspective view of the FIG. 13 embodiment prior to the device being used to open the package.

FIG. 17 is a perspective view of the FIG. 13 embodiment after the device has been used to initiate the opening of the package.

FIG. 18 is a side view of the opening device of FIG. 14 and the portion of the package to which the device is secured.

DETAILED DESCRIPTION OF THE PREFERRED EMBODIMENTS

Figure 1:
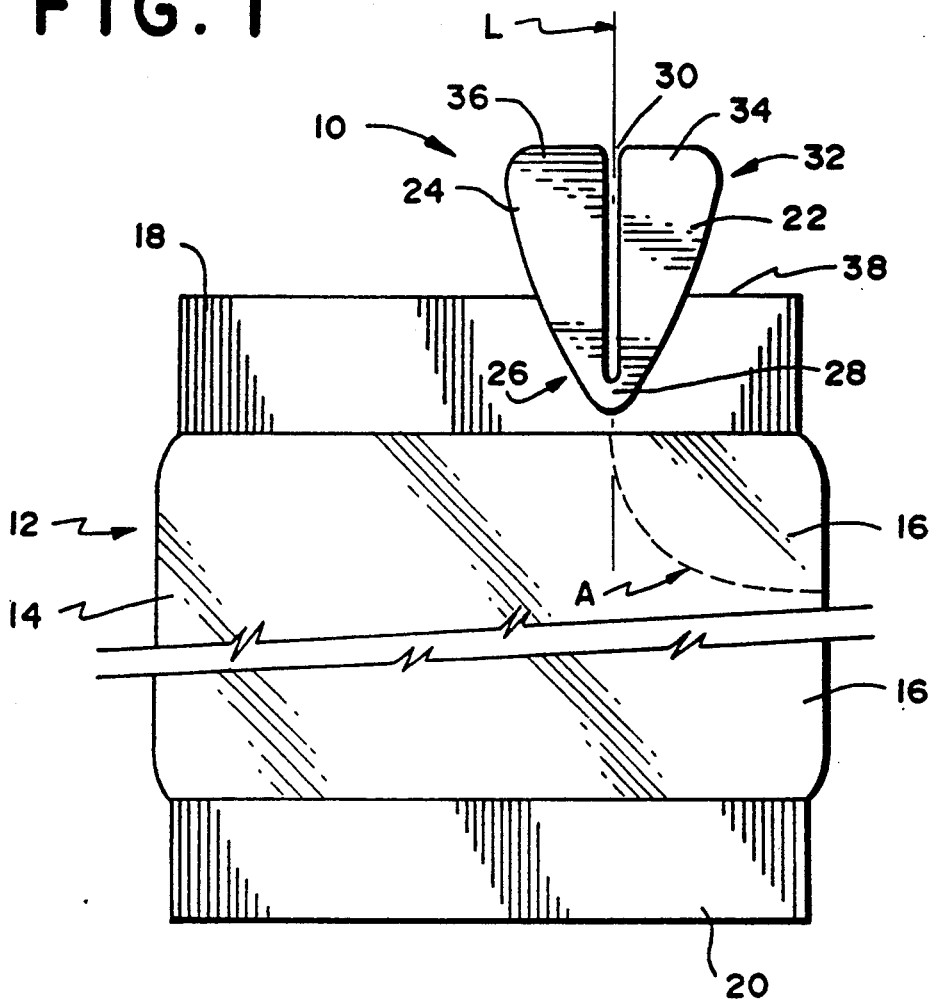
FIG. 1 is an elevation view of the opening device according to a preferred embodiment of the present invention, secured in position to a flexible package.

Referring initially to FIG. 1, an opening device 10 according to a preferred embodiment of the present invention is shown secured to a package 12 made of a flexible packaging material. The opening device 10 is preferably securely fastened or adhered to the package in any one of several ways which will be discussed later in the specification. The device 10 of the present invention is suitable for use with most, if not all, types of packaging materials and package designs which are designed to be torn open to gain access to the contents of the package. Examples of the types of packaging materials with which the device 10 is suitable for use include polyurethane, polyethylene, and other polymeric bag materials, thin foil type sealed packages, heavier weights of paper not easily torn by hand, and foil lined polymeric or paper packaging materials, hereafter referred to as flexible packaging materials. The above list is not, however, to be regarded as all-inclusive, and is provided only to show examples of those types of materials which fall under the collective name "flexible packaging materials".

In the preferred embodiment of FIG. 1, the device 10 is secured to a sealed bag 14, which may be made of polyurethane or the other materials listed above. As is typical of such bags, a sheet of the material forms a contents section 16 of the bag, and the bag is sealed in an airtight manner at an upper sealed end 18 and a lower sealed end 20, forming an enclosure completely around the contents.

The opening device 10 comprises a pair of wing-like members, hereinafter referred to as first wing 22 and second wing 24, joined at a first end, hereinafter termed a proximal end 26 of the device, by a web 28. First and second wings 22, 24, which are preferably sized to accommodate the pads of the index finger and thumb of the user (FIGS. 3, 4), are spaced apart at a narrow predetermined distance by a slit 30 extending from web 28 to a distal end 32 of the opening device 10. The device as shown is substantially symmetrical about a longitudinal axis L extending in the direction of and bisecting the space defined by slit 30.

As can be seen in FIG. 1, preferably only a portion of the opening device 10 is secured to the bag 14, thereby positioning the distal ends 34, 36 of first and second wings 22, 24 to extend outwardly from an upper peripheral edge 38 of the bag. It is preferred that the device 10 be secured to the bag 14 along approximately one-third to one-half of the full length of the device. In the FIG. 1 embodiment, the device is secured to the bag on the upper sealed end 18 thereof, and the slit 30 is oriented such that if the slit were extended inwardly away from the upper peripheral edge of the bag 14, the slit would eventually reach a point at which upper sealed end 18 meets the contents section 16 of the bag. It is possible, if desired, to provide an opening device 10 having sufficient length such that the proximal end 26 of the device actually extends completely across the sealed end 18 of the bag, and onto an exterior surface of the contents section 16 of the bag.

The device serves as a means for initiating and propagating a tear in he package through the sealed end, and into the contents section 16, and in the FIG. 1 orientation is preferably used to tear off a corner portion of the contents section, as indicated by broken line a.

Figure 2:
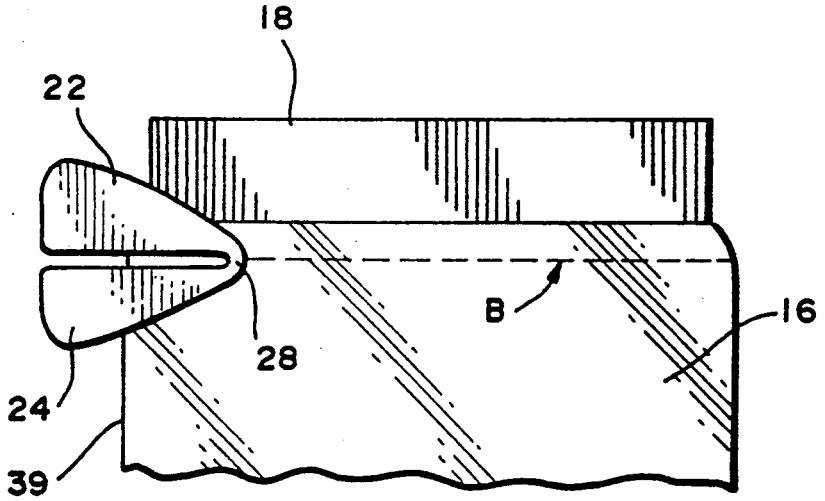
FIG. 2 is an elevation view of the opening device of the present invention secured in an alternate position to a flexible package.

The FIG. 2 embodiment of the opening device 10 of the present invention differs from that of FIG. 1 substantially only int he positioning of the device on bag 14. In this Figure, the device 10 is affixed to the bag in a position adjacent the sealed end 18 of the bag, and at a peripheral edge 39 of the contents section 16 of the bag, wherein the slit 30 extends in a direction extending through the contents section, and preferably parallel to the upper sealed end 18 of the bag. When positioned in such an orientation, the device 10 may be used to initiate and propagate a tear in the package across a top portion thereof, as indicated by broken line B. It is to be recognized from viewing FIG. 2 that the term peripheral edge is used herein not only to refer to a sealed end of a bag 14, such as that shown in FIG. 1, but also to refer to any peripheral boundary of a bag or other type of package.

The operation of the opening device 10 will be discussed by referring particularly to FIGS. 3–5. The present invention was developed in recognition of the fact that the initiation and initial propagation of a tear in the flexible packaging is the largest obstacle in opening a package. As indicated previously, the initiation and initial propagation of a tear in many instances requires the use of a knife, scissors or other sharp object. The opening device 10 of the present invention obviates the need for a separate instrument by providing added leverage and concentration f the tearing forces, such that the package can be opened by hand.

Figure 3:
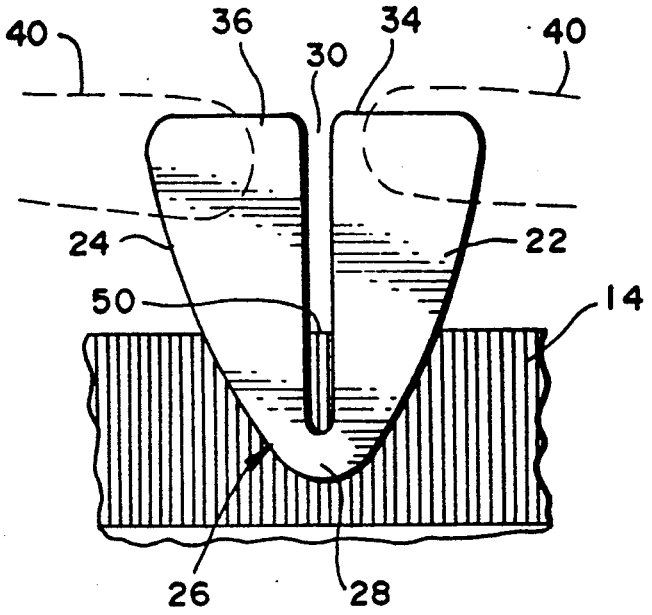
FIG. 3 is an enlarged elevation view of the opening device and the edge of a flexible package to which the opening device is secured.
Figure 4:
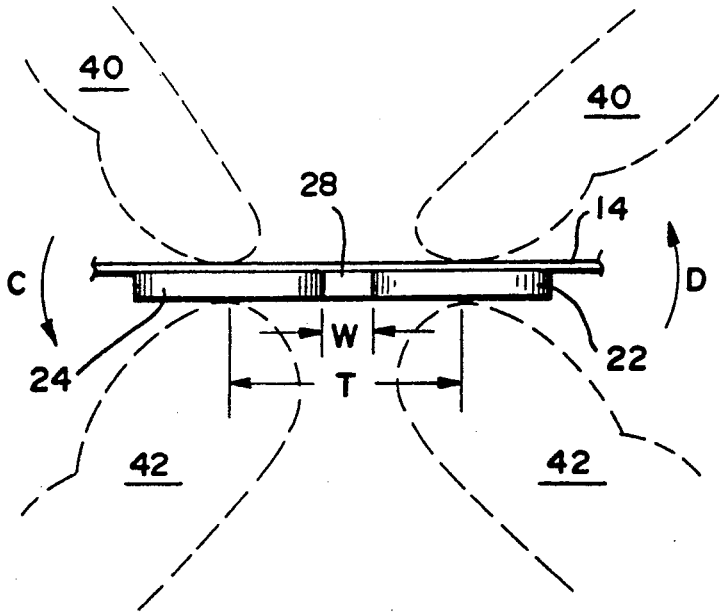
FIG. 4 is a top plan view of the opening device and a portion of the flexible package prior to use.

As can be seen in FIGS. 3 and 4, the first and second wings 22, 24 of the device are preferably sized to provide a gripping surface for a person's fingers 40 and thumbs 42 (broken lines). The wings 22, 24 are gripped between a finger, preferably the index finger, and thumb of each hand. The first and second wings 22, 24 preferably are initially disposed in a flat planar arrangement, as shown in FIG. 4.

Figure 5A:
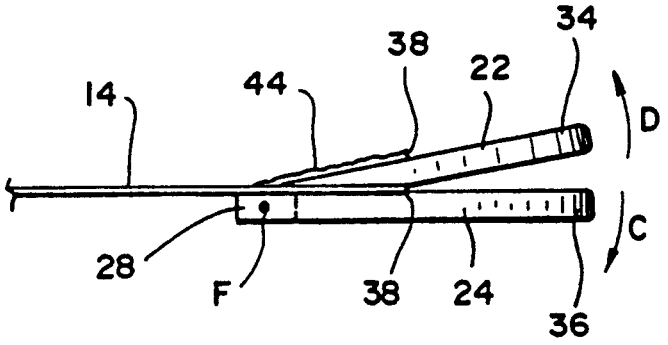
FIGS. 5 *a, b* are side views of the opening device and a portion of the flexible package at an earlier and a later stage, respectively, of using the opening device to initiate the opening of the package.
Figure 5B:
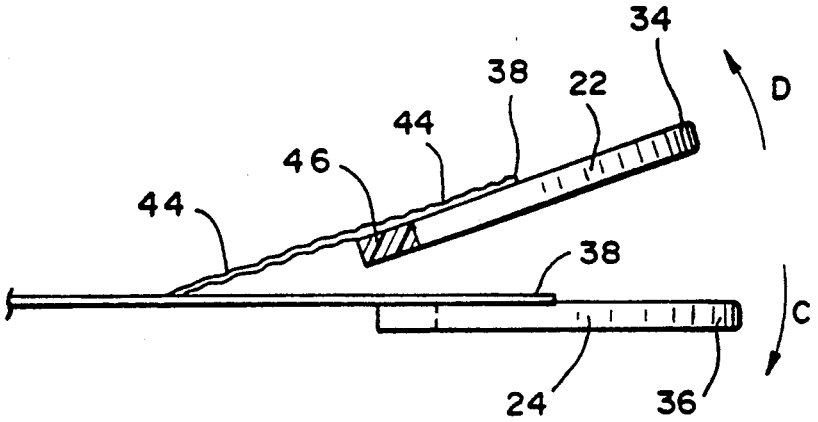

In initiating a tear in the package, the first and second wings 22, 24 are moved relative to one another out of the planar configuration in which they are initially disposed, as indicated by directional arrows C, D (FIGS. 4, 5). Because the wings 22, 24 are initially joined at their proximal end by web 28, the wings each act as levers which are rotated about the web 28, which itself serves as the fulcrum point F (FIG. 5*a*) for each of first and second wings 22, 24.

As can be seen in FIG. 5*a*, first wing 22 and second wing 24 are rotated relative to one another about fulcrum point F, and the portion of the package or bag 14 disposed in the region of slit 30 is sheared to initiate a tear 44 at a peripheral edge 38 of the bag. As the first wing 22 and second wing 24 are rotated further about fulcrum point F, the tear 44 propagates inwardly from peripheral edge 38 toward web 28. The opening device 10 is preferably made of a substantially rigid material, so that wings 22, 24 will properly act as levers in assisting the opening of the bag 14.

In addition to being made of a substantially rigid material, the opening device 10 is also preferably constructed such that the web 28 will break apart at fracture area 46 (FIG. 5*b*) as the distal ends 34, 36 of wings 22, 24 are rotated farther apart from one another. The fracture 46, which separates first wing 22 from second wing 24, will preferably occur in the web just prior to or at the same time as the tear 44 in the bag 14 has propagated to the region of the bag to which web 28 is secured. An opening device designed in this manner allows the wings 22, 24 to provide the increased leverage desired to initiate the tear 44 and to promote the initial propagation of the tear, while at the same time allowing the unobstructed continuation of the tear 46 (FIG. 5*b*), to complete the opening of the package. Once the fracture 46 has occurred, the first wing 22 and second wing 24 may be moved independently of one another, allowing a larger tear to be made.

The desired fracture characteristics of web 28 in opening device 10, are affected by several factors related to the configuration and the material properties of the device. The shape, size, and thickness of the device, including the slit and web configurations, will preferably be closely matched with the strength, rigidity and brittleness of the material from which the device is made such that the fracture will be accomplished at the desired point under average effort or exertion by the person opening the package.

The action of first and second wings 22, 24 as levers increases the shearing force on the package material over that produced by ripping the peripheral edge 38 of the bag with one's thumbs and forefingers alone and applying a tearing or shearing force to the bag. By positioning the opening device 10 such that the distal ends 34, 36 of first and second wings 22, 24 extend outwardly away from the peripheral edge 38 of the bag, while the web 28 comprising the fulcrum is located on the opposite (inner) side of peripheral edge 38, a second-class lever is created. Thus, the mechanical advantage provided by first and second wings 22, 24 in tearing the peripheral edge 38 of the bag increases as the length of the distal ends 34, 36 extending from the peripheral edge 3 is increased. As depicted in FIG. 3, a preferred positioning of the device 10 relative to the peripheral edge 38 of the package 14 leaves approximately two-thirds of the overall length of opening device 10 extending outwardly from the peripheral edge, leaving approximately one-third of the length secured to the package. Such a positioning approximately triples the amount of shear experienced at the peripheral edge of the package, as compared with gripping the package directly, for the same amount of effort employed by the person attempting to open the package.

The ability to initiate and propagate a tear in the package is further improved by concentrating or confining the shearing forces at the portion 50 (FIG. 3) of the peripheral edge of the package between the first wing 22 and second wing 24, i.e. the area defined by slit 30. As depicted in FIG. 4, the width dimension W of the slit 30 is substantially smaller than the width dimension T that is achievable between the thumbs 42 in a comfortable gripping position directly on the package itself. The slit, which may preferably be of a width on the order of 1–2 mm, or possibly even narrower, may be as much as four times narrower than the distance between the thumbs in a comfortable gripping position. The resulting concentration of forces thus substantially reduces the effort required to initiate a tear at the peripheral edge of the package.

The opening device 10 as depicted in FIGS. 1-5 is preferably joined to the bag 14 or other type of package made of flexible packaging material, and particularly polymeric packaging materials, by heat sealing the proximal end 26 of the opening device 10 to the surface of the bag 14 at the desired peripheral surface thereof. The application of a sufficient amount of heat and pressure to the device 10 and the peripheral edge of the bag 14 will substantially irreversibly bond the device 10 to the bag 14, and is believed to be a suitable process for achieving the necessary irreversible bond for many of the packaging materials and opening device materials anticipated for use in connection with the present invention.

Other methods for obtaining the necessary bond between the device and the package may be employed should heat sealing provide impracticable or uneconomical for certain package materials or opening device materials. An adhesive, such as a urethane or an epoxy adhesive may be employed, for example, in securing or bonding an opening device 10 to polyethylene packaging materials. The surface of the polyurethane may optionally be treated in order to further improve the adhesion of the device to the packaging material, a proposed surface treatment comprising cleaning the surface with isopropyl alcohol or acetone, lightly abrading the surface with sandpaper or wire brush, and dipping the area into a heated solution of sulfuric acid/potassium dechiromate/water for a short period of time, such as 30 seconds. Other candidate adhesives, depending on the type of packaging material and opening device material employed, include hot melt glues of an ethylene-vinyl acetate or ethylene-ethyl acetate copolymer compositions.

The material from which the opening device 10 is mad is preferably selected for both its mechanical properties and its adhesive qualities, including its compatibility with the type of packaging material being employed. A preferred candidate material is crystal styrene, which possesses good strength and rigidity, good brittle fracture characteristics, good adhesive qualities, and low material cost. Other materials which may be suitable for use as the opening device include ABS (acrylonitrile butadiene styrene) plastics, PBT (polybutylene terephthalate) plastics, polyacrylate and polycarbonate.

Figure 6:
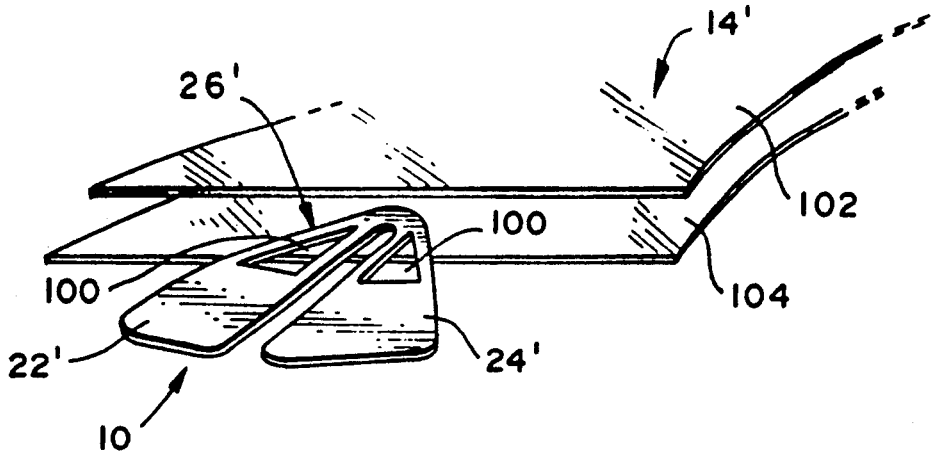
FIG. 6 is a perspective view of an alternative preferred embodiment of the opening device of the present invention and two portions of the flexible packaging to which the device is to be secured.

In some instances, it may be desired to employ a type of flexible packaging material and a opening device material which are incompatible from the standpoint of obtaining a high-quality reliable bond between the materials. In such instances, an alternative embodiment of the opening device of the present invention may be secured to the flexible packaging material using alternative means for holding the device in place. FIG. 6 depicts such an alternative embodiment of the opening device 10', wherein each of a first and second wings 22', 24', have a cutout section 100 disposed at the proximal end 26' of the device. When configured in this manner, the device 10' may be inserted between two edges 102, 104 of the bag 14' prior to the sealing of the bag, and when the bag edges 102, 104 are heat-sealed or otherwise-sealed together, the bag edges will also seal in the areas left open by cutout sections 100. The proximal end 26' of opening device 10' will thus be encased by and captively retained between the sealed edges 102, 104 of the bag 14. The opening device 10' is used to initiate a tear in the bag in the same manner as described with respect to the FIG. 1-5 embodiment of the opening device.

Figure 7:
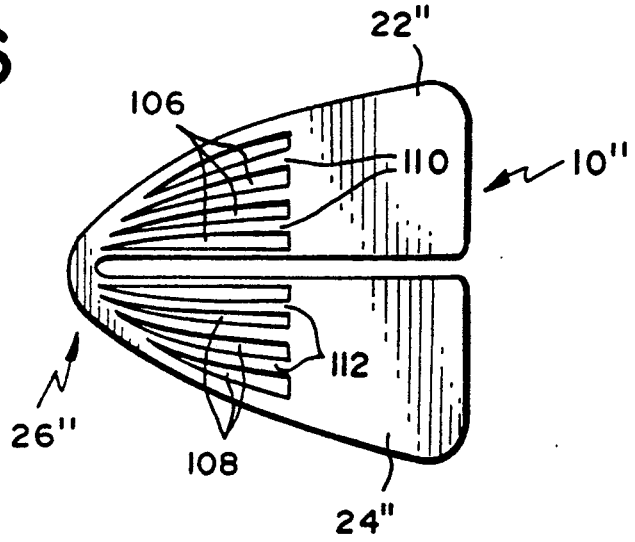
FIG. 7 is an elevation view of an alternative preferred embodiment of the opening device of the present invention.

FIG. 7 depicts a further alternative preferred embodiment of an opening device 10'' in accordance with the present invention. Each of first and second wings 22'', 24'' is provided with a plurality of cutout sections 106, 108, separated by splines 110, 112, the open areas created by the cutout section serving essentially the same purpose as those in the FIG. 6 embodiment, namely to provide open area in the proximal end 26'' of each wing through which the flexible packaging material is permitted to seal upon itself. The FIG. 7 embodiment is believed to provide increased concentration of tearing forces on the peripheral edge of the bag as compared with the FIG. 6 embodiment, and would thus be preferred if the additional concentration of forces is believed to be necessary or desirable in a particular application.

Figure 8:
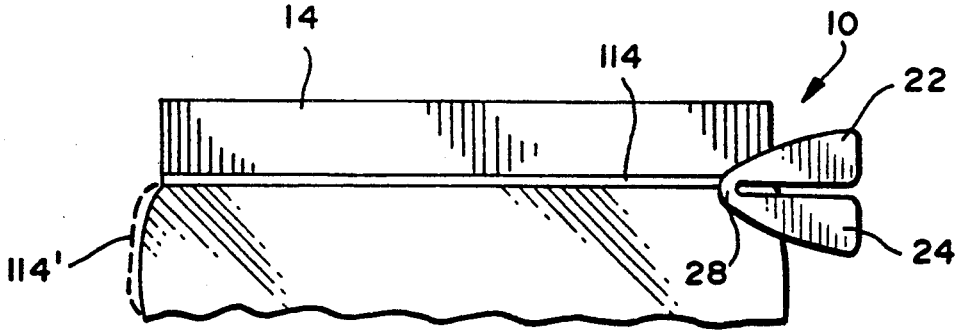
FIG. 8 is an elevation view of an alternative preferred embodiment of the opening device and package of the present invention.

FIG. 8 depicts an alternative preferred embodiment of the opening device 10 of the present invention which is especially well suited for use with more durable flexible packaging materials such as freeze-dried coffee packs or dog food bags currently found in the marketplace. In this embodiment, first wing 22 has a tear string 114 attached at its proximal end. The tear string 114 may preferably be embedded in the packaging material or otherwise attached to the packaging material in a manner known in the art, and will extend across a predetermined portion of the packaging material where it is desired to effect a tear.

In this embodiment, the opening device 10 is operated in the same manner as with the previously described embodiments, and upon achieving fracture at web 28, first wing 22 may be further pulled to initiate the operation of the tear string 114 in propagating a tear across bag 14. The tear string 114 operates in a manner known in the art to concentrate shearing or tearing forces along the string in facilitating the opening of bag 14. The use of the tear string in combination with the opening device provides the ability to initiate a tear and to propagate a tear through tougher and more durable packaging materials using normal human effort without requiring resort to separate cutting or opening tools. The tear string 114 may preferably be made of a fishing line material such as nylon, or other suitable polymeric line materials. The tear string 114 could also have an additional portion 114', firmly attached to the bag beyond the area of expected tearing, the object being to reduce consumers' inadvertent littering by designing the bag to not separate into two sections after a tear is effected to gain access to the bag's contents (FIG. 8).

FIGS. 9–17 depict two further preferred alternate embodiments of the opening device of the present invention which are particularly useful when the opening device is to be secured to a sealed edge of a bag. In these embodiments, the rigid wing-like members or levers are not physically connected by an integral web, as in the foregoing embodiments, but the wing-like members or levers are connected to one another by way of the package material to which the levers are attached. The levers are attached to the package such that they will operate about a common fulcrum to provide increased tearing force to facilitate the opening of a package.

In FIG. 9–13 the flexible package opening device 200 is depicted as a pair of levers, designated as a first lever 202 and a second lever 204. Each of these levers has a proximal end 206 secured to a sealed edge 208 at the periphery 209 of a flexible package 210. The sealed edge will usually be formed by sealing together, in any conventional manner, a first and second layer 212, 214 (FIGS. 10–12) of the sheet-like package material. The first lever 202 is secured, as by heat sealing or other means discussed earlier in the specification, to the first layer 212 of the sealed edge, and the second lever 204 is secured in a similar manner to the second layer 214 of the sealed edge.

The outwardly facing surface of first layer 212 will also be referred to as front surface 232, and the outwardly facing surface of second layer 214 will alternatively be referred to as back surface 234. As can be seen especially in FIGS. 10–13, the levers 202, 204 can be described as being secured to opposite sides (the front and back surfaces) of the sealed edge 208 of the package 210. In certain instances, the sealing of layers 212, 214 may be so complete as to fuse the layers together, making it impossible to distinguish one layer from the other. In this case, the sealed edge 208 will still retain a front surface 232 and a back surface 234.

As seen in FIG. 9, the proximal ends 206 of first and second levers 202, 204, are secured to the package such that there is a physical overlap at the innermost portions of the proximal ends when viewed from a direction perpendicular to a plane (the plane of the paper) in which the sealed edge 208 lies. This overlap of the proximal ends 206 of the levers 202, 204 provides each of the levers with an abutting surface for the other lever, giving the device a common fixed point, or common fulcrum 216 (FIGS. 9–13), substantially at the innermost portions 220, 222 of the proximal ends 206, about which the levers can be rotated to assist in opening the package.

FIGS. 12 and 13 best illustrate that the device 200 is employed to open the package by rotating the distal ends 218 of the levers 202, 204, away from each other about an axis E extending through fulcrum 216 in a direction along the extent of the sealed edge 208 of the package. The solid lines in FIG. 13 show the initial positions of the levers 202, 204 and layers 212, 214 of the sealed edge of the package, and the broken lines in that figure show the positions of those elements after the device has been used to initiate an opening in the package. As can be seen in those figures, the depicted opening of the package is by tearing the layers of the sealed edge apart from one another.

In the situation previously mentioned wherein the layers 212, 214 are completely fused so as to form a single sealed layer, the opening device 200 may operate to create a tear in the sealed edge between the levers instead of separating the sealed layers from one another as shown in FIGS. 12–13. In fact, the opening device is capable of operating in that mode whenever the adhesion forces between the layers are greater than the shear strength of the material at the sealed edge. Tearing forces in this embodiment are increased by the action of the levers, and are concentrated at only the portion of the sealed edge designated by numeral 250. As such, the device greatly facilitates opening the package.

Turning now to FIG. 14–17, a variant on the opening device of FIGS. 9–13 is depicted. The opening device 300 is similar in many respects to opening device 200, with the principal exception that there is no physical overlap (see FIG. 14) of the first and second levers 302, 304, when the package and device are viewed in a direction perpendicular to a plane (the plane of the paper) in which the sealed edge 308 of the package lies. It has been determined, in connection with the development of the present invention, that the proximal ends 306 of the first and second levers 302, 304, need not have an actual area of overlap, as is present in device 200 of FIG. 9, in order for the device to have and to operate about a common fulcrum. The first and second levers 302, 304 need only be spaced sufficiently closely together (FIG. 14) such that the proximal ends 306 of the levers coact with the package material disposed between the levers (FIG. 15) such that a common fixed point or common fulcrum 316, about which the levers 302, 304 will rotate, is maintained. The preferred spacing is on the order of 1 mm or less. If the spacing is much larger than a couple of millimeters, the levers will not likely to be able to form a common fulcrum with the packaging material extending between the innermost portions of the proximal ends of the levers, due to the increased freedom of movement permitted by the greater amount of packaging material between the levers.

The opening device 300 is operated in the same manner as is device 200 to open a package. The distal ends 318 of the levers are rotated in opposite directions about axis E' extending in the direction of the extent of sealed edge 308 of the package 310. As can best be seen in FIG. 18, this outward rotation of the distal ends of the levers urges the innermost portions 320, 322 of the proximal ends 306 of the levers inwardly toward each other. The packaging material disposed between the innermost portions 320, 322 of the proximal ends of levers 302, 304, is restricted from substantial movement by the opposing forces exerted by the proximal ends, and the material itself restricts further movement of the innermost portions of the proximal ends of the levers. The levers 302, 304 thus operate about a common fixed point, or common fulcrum 316, to provide the force multiplication at the distal ends 318 of the levers 302,

304, which act on layers 312, 314 to separate the layers from one another or to create a tear in the sealed edge of the package. In this embodiment wherein the levers do not overlap, these multiplied forces act on substantially only a very small portion of the sealed layers, designated in FIG. 15 by numeral 350, as this is the portion of the sealed edges where the opposing separation forces are concentrated.

FIG. 18 further shows that, even when the innermost portions 320, 322 of the proximal ends 306 of levers 302, 304 extend inwardly past the sealed edge 308 of the package, the levers 302, 304 will act about a common fulcrum once the freedom of movement of the unsealed package material is eliminated by the opposing forces of the proximal ends 306 of the levers.

Although the devices in the embodiments of FIGS. 9–18 are capable of altering the manner in which the package is opened (layer tearing) from that when the devices of FIGS. 1–8 are employed, these embodiments share several of the same advantages for opening flexible packages. The provision for a pair of two levers 202, 204; 302, 304, operating about a common fulcrum 216, 316 gives these devices the ability to increase or multiply the forces required to open the package to gain access to the contents thereof. The use of distal end sections of the levers which are not secured to and extend free of the package provides a very convenient gripping means which enables easy operation of the levers. The overlap or close spacing of the two levers concentrates the forces operating to separate the sealed layers or to tear the sealed edge at a relatively small area of the edge of the package, which further increases the effectiveness of the forces multiplied by the levers.

In the embodiment depicted and described with respect to FIGS. 9–18, it is desired that the levers 202, 204; 302, 304 be heat sealed to the sealed edge of the package over a majority of the area at which the proximal ends contact the sealed edge. Alternatively, it is desired to heat seal the proximal ends of the levers to the edge of the package roughly along the outline of the area of contact of the proximal ends and the sealed edge, as shown by the broken lines in FIGS. 11 and 16.

The foregoing description includes various details and particular features according to preferred embodiments of the present invention, however, it is to be understood that this is for illustrative purposes only. Various modifications and adaptations may become apparent to those of ordinary skill in the art without departing from the spirit and scope of the present invention. For example, although the wing-like members of the device in most of the figures are depicted as forming an approximately "heart shaped" device, the shape of the wing-like members may take on numerous other forms, provided sufficient area exists for the placement of the fingers and thumbs for gripping the device. Accordingly, the scope of the present invention is to be determined by reference to the appended claims.

What is claimed is:

1. A flexible package having an opening device for magnifying and concentrating opening forces on the package, said opening device comprising:

a pair of levers comprising a first lever and a second lever secured to said package;

a fulcrum common to both said first and said second levers, said common fulcrum located at a proximal end section of said first lever and said second lever;

means for separating said first lever and said second lever from each other at said common fulcrum after an opening is produced in said package;

means for gripping said first lever and said second lever, said gripping means disposed at a distal end of each of said first and second levers;

wherein only predetermined portions of said proximal ends of said first lever and said second lever are securely bonded to said package, the gripping means at said distal end of the first and second levers extending free of said package, and wherein said device is operable to tear a portion of said package disposed between said first and second levers when said first and second levers are rotated in opposite directions about said fulcrum, and wherein said first and second levers ar secured only to opposite sides of a peripheral edge of said package, and said common fulcrum comprises an innermost portion of each of said proximal ends of said first and second levers and a portion of said peripheral edge of said package which is disposed between said first and second layers.

2. A flexible package having an opening device secured thereto for providing increased mechanical advantage in opening the package, the package having at least one peripheral edge comprising a front surface and back surface, said opening device comprising:

a first lever secured only to said front surface of said peripheral edge and a second lever secured only to said back surface of said peripheral edge, said first and second levers having only a proximal end of each lever secured to said peripheral edge, with a distal end of each lever extending free of said package;

said first and second levers being secured to said peripheral edge in positions such that an innermost portion of each of said proximal ends and the package material located between said innermost portions forms a common fulcrum about which said first and second levers can be rotated to apply tearing forces to said package at an area of said package disposed between said first and second levers.

3. A flexible package as recited in claim 2 wherein said first and second levers of said opening device at least partially physically overlap one another when viewed in a direction perpendicular to a plane of the peripheral edge of the package.

4. A flexible package as recited in claim 2, wherein said proximal ends of said first and second levers of said opening device define a narrow gap between said levers when viewed in a direction perpendicular to a plane of the peripheral edge of the package.

5. A flexible package having an opening device for magnifying and concentrating forces in opening a package, the package having at least one peripheral edge having front and back surfaces, said opening device comprising:

a pair of levers comprising a first lever and a second lever, a proximal end of said first lever being secured only to said front surface of said at least one peripheral edge of said package, a proximal end of said second lever being secured only to said back surface of said peripheral edge;

a fulcrum common to both said first and second levers, said common fulcrum being located at and between said proximal end sections of said first and second levers, said first and second levers being spaced apart from each other by at least a thickness of said peripheral edge of said package;

means for separating said first lever and said second lever at said common fulcrum after said first and second levers have at least partially propagated an opening in said package;

means for gripping said first lever and said second lever, said gripping means being disposed at a distal end of each of said first and second levers;

wherein only predetermined portions of said proximal ends of said first lever and said second lever are secured to said package, the gripping means at the distal ends of the levers extending free of said package, and wherein said first and second levers are operable to tear open a portion of said package disposed at said portion of said peripheral edge to which said first and second levers are secured when said first and second levers are rotated in opposite directions about said common fulcrum.

6. A flexible package as recited in claim 5, wherein said common fulcrum of said opening device comprises an innermost portion of each of said proximal ends of said first and second levers, and a portion of the package extending between said innermost portions of said proximal ends.

7. A flexible package having an opening device for magnifying and concentrating forces n opening a package, the package having at least one peripheral edge having front and back surfaces, said opening device comprising:

a pair of levers comprising a first lever and a second lever, a proximal end of said first lever being secured to said front surface of said at least one peripheral edge of said package, a proximal end of said second lever being secured to said back surface of said peripheral edge;

a fulcrum common to both said first and second levers, said common fulcrum being located at and between said proximal end sections of said first and second levers, said first and second levers being spaced apart from each other by at least a thickness of said peripheral edge of said package;

means for separating said first lever and said second lever at said common fulcrum after said first and second levers have at least partially propagated an opening in said package;

means for gripping said first lever and said second lever, said gripping means being disposed at a distal end of each of said first and second levers;

wherein only predetermined portions of said proximal ends of said first lever and said second lever are secured to said package, the gripping means at the distal ends of the levers extending free of said package, and wherein said first and second levers are operable to tear open a portion of said package disposed at said portion of said peripheral edge to which said first and second levers are secured when said first and second levers are rotated in opposite directions about said common fulcrum, wherein said common fulcrum of said opening device comprises an innermost portion of each of said proximal ends of said first and second levers, and a portion of the package extending between said innermost portions of said proximal ends, and wherein said innermost portions of said proximal ends of said first and second levers at least partially physically overlap, and said common fulcrum of said opening device further comprises an overlapping portion of each of said proximal ends of said first and second levers.

8. A flexible package as recited in claim 3 wherein said innermost portions of said proximal ends of said first and second levers at least partially physically overlap.

9. A flexible package as recited in claim 3 wherein at least a portion of said distal ends of said first and second levers at least partially physically overlap.

* * * * *